US007619497B2

(12) United States Patent
Yuba et al.

(10) Patent No.: US 7,619,497 B2
(45) Date of Patent: Nov. 17, 2009

(54) ELECTROSTATIC RELAY

(75) Inventors: Takashi Yuba, Shinagawa (JP); Hideki Iwata, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 273 days.

(21) Appl. No.: 11/237,843

(22) Filed: Sep. 29, 2005

(65) Prior Publication Data

US 2006/0087390 A1 Apr. 27, 2006

(30) Foreign Application Priority Data

Oct. 21, 2004 (JP) ..... 2004-306862

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,613,993 B1 * 9/2003 Strumpler ..... 200/181
6,686,639 B1 * 2/2004 Tsai ..... 257/415
6,744,173 B2 * 6/2004 Behin et al. ..... 310/309
6,798,315 B2 * 9/2004 Schaefer ..... 333/105
7,253,709 B1 * 8/2007 Chang et al. ..... 335/78
2006/0180883 A1 * 8/2006 Kouma et al. ..... 257/415
2007/0024390 A1 * 2/2007 Hong et al. ..... 333/105

FOREIGN PATENT DOCUMENTS

JP 9-251834 9/1997
JP 2002-289081 10/2002
JP 2002-326197 11/2002

* cited by examiner

*Primary Examiner*—Lincoln Donovan
*Assistant Examiner*—Bernard Rojas
(74) *Attorney, Agent, or Firm*—Staas & Halsey LLP

(57) ABSTRACT

An electrostatic micro relay, in which the contact gap between moving and fixed contacts may be increased and the reliability and high-performance regarding contacting and separating the moving contact with and from the fixed contact may be improved. In the micro relay according to the invention, as a comb-shaped moving electrode is supported at an obliquely upper position relative to a fixed comb-shaped electrode, the contact gap may be lengthened. When a predetermined voltage is applied between the contacts, the moving electrode is moved obliquely downward toward the fixed electrode such that the contact surface of the moving electrode slidably contacts the contact surface of the fixed electrode. This slidably contact may cause a wiping effect, whereby each contact surface may be kept clean.

6 Claims, 18 Drawing Sheets

ELECTROSTATIC RELAY

BACKGROUND OF THE INVENTION

1. Field of the Invention

The present invention relates to an electrostatic relay and, in particular, to an electrostatic micro relay activated by an electrostatic force.

2. Description of the Related Art

An electrostatic micro relay is a super micro relay made by using a technique for processing a semiconductor and is used for alternating electrical signals or high frequency signals. The micro relay contacts and separates a moving contact with and from a fixed contact, by utilizing electrostatic attraction. As types of such micro relays, a cantilever type in which a moving electrode having a generally plate shape is supported at only one end thereof, a parallel plate type in which the moving electrode is movably supported at both ends thereof, or a comb type in which each of a moving and a fixed electrodes has a comb-shape capable of engaging with each other, are possible.

In the electrostatic relay, the electrostatic attraction force is in proportion to a square of the voltage between a fixed electrode and a moving electrode and is in inverse proportion to a square of the distance between the electrodes. Therefore, in order to reduce a required voltage for activation, the distance between the electrodes must be short. In this case, it is difficult to increase a contact gap between a fixed contact of the fixed electrode and a moving contact of the moving electrode. However, it is very important to obtain a large contact gap in the design of the micro relay, because a large contact gap is preferably for restraining discharge between the electrodes and leakage of the high frequency signal.

In this regard, Japanese Unexamined Patent Publication (Kokai) No. 9-251834 discloses an electrostatic relay including a fixed electrode and a moving electrode, both of the electrodes having comb-shaped structures, in order to lengthen the contact gap. In this electrostatic relay, the moving contact is movable in parallel with a substrate so as to contact or separate with or from the fixed contact. The electrostatic attraction force between the contacts may be relatively large, due to the comb-shaped structure of the electrodes, whereby the contact gap may be extended.

On the other hand, Japanese Unexamined Patent Publication (Kokai) No. 2002-289081 discloses an electrostatic micro relay having a movable substrate supported at two points symmetrically positioned in relation to a moving contact. This relay has a protrusion capable of contacting a substrate in order to increase a contact opening force and to stabilize the contact and the separation between two contacts.

Further, Japanese Unexamined Patent Publication (Kokai) No. 2002-326197 discloses a MEMS element having a movable substrate and a stopper or a protrusion arranged on the substrate by which a repulsive force of a spring supporting the substrate may change nonlinearly.

In the comb-type relay, as described above, the electrostatic attraction force may be increased by enlarging the surface areas of the comb-shaped electrodes opposing each other. Therefore, a contact gap between the electrodes may be increased. However, in the relay described in Japanese Unexamined Patent Publication (Kokai) No. 9-251834, for example, as the moving electrode may move only in a horizontal direction, the moving contact abuts to the fixed contact such that each abutting point of the two contacts is always the same. Therefore, in particular when the contact and the separation of the contacts are frequently repeated, only the same point of each contact is worn and damaged, whereby the life of each contact becomes shorter and the contacts must be exchanged more frequently.

On the other hand, in the parallel plate type relay, the moving electrode or a movable plate may be moved perpendicular to a surface while the movable plate is parallel to the fixed electrode. Therefore, when a spring constant of a spring supporting the moving electrode is relatively low, the contact gap may be increased and the electrode may be moved by a relatively low electrostatic force. However, when the spring constant is low, a mechanical malfunction due to mechanical vibration or external noise may occur, further, sticking or adhesion between the contacts may be caused as the opening force for separating the moving contact from the fixed contact becomes smaller. Therefore, a large contact gap is not allowed. On the other hand, when the spring constant is high, a high stress is applied to the spring on contacting or separating the moving contact with or from the fixed contact, whereby the life of the spring becomes shorter.

The cantilever type relay has a simple configuration and is easily made, however, this type of relay requires a larger electrostatic force than that of other types of relay having the same contact gap. Therefore, it is difficult to obtain the large contact gap in the cantilever relay. Further, a high stress is applied to the cantilever on contacting or separating the moving contact with or from the fixed contact, whereby the life of the cantilever or the moving contact becomes shorter. Some cantilever-type relays have been developed to realize a large contact gap, however, each of these relays has a complicated electrode configuration and a high production cost.

SUMMARY OF THE INVENTION

Accordingly, an object of the present invention is to provide an electrostatic relay realizing a large contact gap and having a high reliability and a good performance in relation to the contact and the separation between two contacts of the relay.

In order to accomplish the above object, according to one embodiment of the present invention, there is provided an electrostatic relay comprising: a fixed contact having a contact surface; a fixed electrode having a fixed comb-shaped structure; a moving electrode having a movable comb-shaped structure movably supported and positioned away from the fixed electrode, the movable comb-structure extending in the direction opposing and parallel to the extending direction of the fixed comb-shaped structure such that the movable and fixed comb-shaped structures together form a step; a moving contact attached to the moving electrode and having a contact surface capable of being contacted with and separated from the contact surface of the fixed contact; wherein when a predetermined voltage is applied between the fixed electrode and moving electrode, the moving electrode moves such that the distance between the fixed and the movable comb-shaped structures is reduced and the height of the step formed by the movable and fixed comb-shaped structures is reduced.

Preferably, the direction of movement of the moving electrode forms an oblique angle with at least one of the contact surface of the fixed contact and the contact surface of the moving contact.

The electrostatic relay may further comprise a stopper for limiting the extent of the movement of the moving electrode.

According to another embodiment of the present invention, there is provided an electrostatic relay comprising: a fixed contact; a first fixed electrode; a second fixed electrode having a fixed comb-shaped structure; a moving electrode having a plate portion movably supported and positioned away from the first fixed electrode, the plate portion comprising a movable comb-shaped structure facing the fixed comb-shaped structure and a moving contact capable of being contacted with and separated from the fixed contact; wherein the moving electrode is moved toward the first fixed electrode by both of a first electrostatic attraction force acting between the first fixed electrode and the plate portion of the moving electrode and a second electrostatic attraction force acting between the fixed comb-shaped structure of the second fixed electrode and the movable comb-shaped structure of the moving electrode.

Preferably, the second electrostatic attraction force acts so as to separate the movable contact from the fixed contact while the moving contact contacts the fixed contact or the moving contact is being moved toward the fixed contact. In this case, the fixed contact and the first and second fixed electrodes may be arranged on a substrate and an insulating layer, having a height greater than both of the fixed contact and the first fixed electrode, may be arranged between the comb-shaped structure of the second fixed electrode and the substrate.

Preferably, the thickness of the plate portion of the moving electrode is less than the thickness of the movable comb-shaped structure.

Preferably, an insulating membrane is formed on at least one of the first fixed electrode and the moving electrode and the insulating membrane has grooves together forming a lattice.

According to still another embodiment of the present invention, there is provided an electrostatic relay comprising: a fixed contact; a fixed electrode; a moving electrode movably supported and positioned away from the fixed electrode, the moving electrode comprising at least one fixed end and a spring portion connected to the fixed end, the spring portion comprising a moving contact capable of being contacted with and separated from the fixed contact and a plurality of turned portions, at least one of the turned portions being positioned between the fixed end and the moving contact.

At least one of the turned portions may include a notch.

Preferably, the spring portion includes two fixed ends at both ends thereof, the moving contact is positioned at generally the center of the spring portion, the two fixed ends and the moving contact are not aligned, and the spring portion has a slit, on the center of the spring portion, extending from the point near the moving contact to the opposite side to the moving contact.

The electrostatic relay may comprise: at least two moving electrodes having moving contacts positioned adjacent to each other; and a common terminal for connecting fixed contacts each capable of contacting and separating from each moving contact.

Preferably, an insulating membrane is formed on at least one of the fixed electrode and the moving electrode and the insulating membrane has grooves together forming a lattice.

The electrostatic relay according to each embodiment may further comprise a cap substrate for sealing a moving part of the electrostatic relay.

The electrostatic relay may comprise at least two fixed contacts.

Preferably, the moving electrode is made of an organic material including a polyimide.

DETAILED DESCRIPTION

The above and other objects, features and advantages of the present invention will be made more apparent by the following description of the preferred embodiments thereof, with reference to the accompanying drawings, wherein:

FIG. 1*a* is a schematic plan view of a micro relay according to a first embodiment of the invention, when two contacts of the relay are away from each other;

FIG. 1*b* is a cross-sectional view along b-b line of FIG. 1*a;*

FIG. 1*c* is a perspective view of a fixed electrode and a moving electrode of the micro relay of FIG. 1*a;*

FIG. 2*a* is a schematic plan view similar to FIG. 1*a*, when the two contacts of the relay contact each other;

FIG. 2*b* is a cross-sectional view along b-b line of FIG. 2*a;*

FIG. 3*a* is a schematic plan view of a first modification of the micro relay of the first embodiment, when two contacts of the relay are away from each other;

FIG. 3*b* is a cross-sectional view along b-b line of FIG. 3*a;*

FIG. 4*a* is a schematic plan view similar to FIG. 3*a*, when the two contacts of the relay contact each other;

FIG. 4*a* is a perspective view of a fixed electrode and a moving electrode of the micro relay of FIG. 1*a;*

FIG. 4*b* is a cross-sectional view along b-b line of FIG. 4*a;*

FIG. 5*a* is a schematic plan view of a second modification of the micro relay of the first embodiment;

FIG. 5*b* is a view similar to FIG. 5*a*, when the moving electrode is removed;

FIGS. 6*a*-6*i* show a series of diagrams of a method for producing a main part of the micro relay of the first embodiment, each representing forming a fixed contact, forming a sacrificial layer, forming a moving contact, reconstituting a sacrificial layer and patterning, forming a structure, forming a mask, forming a comb-shaped structure, removing the mask, and, etching and removing the mask and the sacrificial layer;

FIG. 7*a* is a schematic plan view of a micro relay according to a second embodiment of the invention;

FIG. 7*b* is a view similar to FIG. 7*a*, when the moving electrode is removed;

FIG. 8*a* is a cross-sectional view along 8-8 line of FIG. 7*a*, when a moving contact of the relay starts to move toward a fixed contact;

FIG. 8*b* is a view showing a condition in which the electrostatic attraction force between the comb-shaped structures of the micro relay is maximum;

FIG. 8*c* is a view when the contacts of the relay contact each other;

Figure 10:
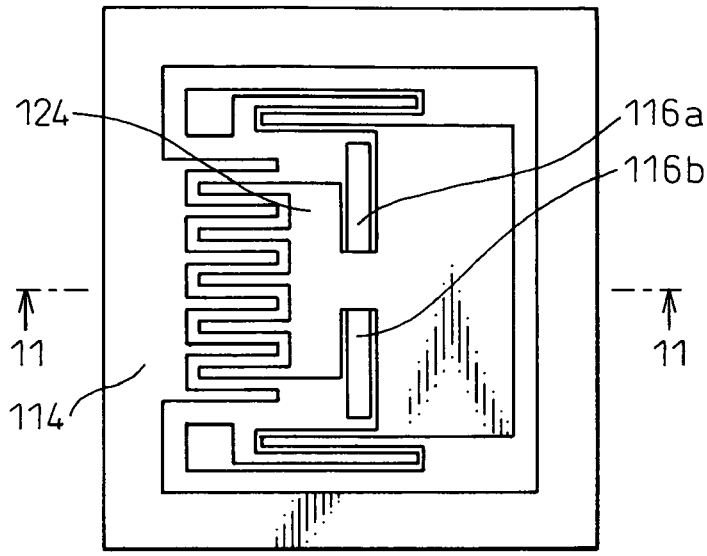
FIG. 10 is a view of a second modification of the micro relay of the second embodiment.
Figure 11A:
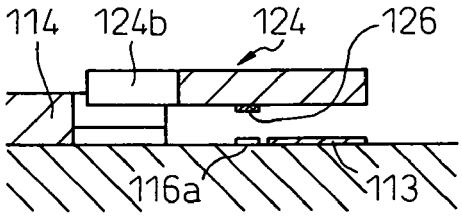
Figure 11B:
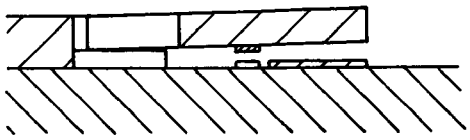
Figure 11C:
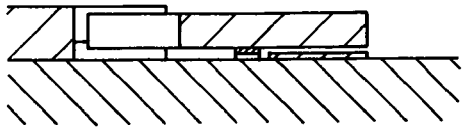
Figure 12:
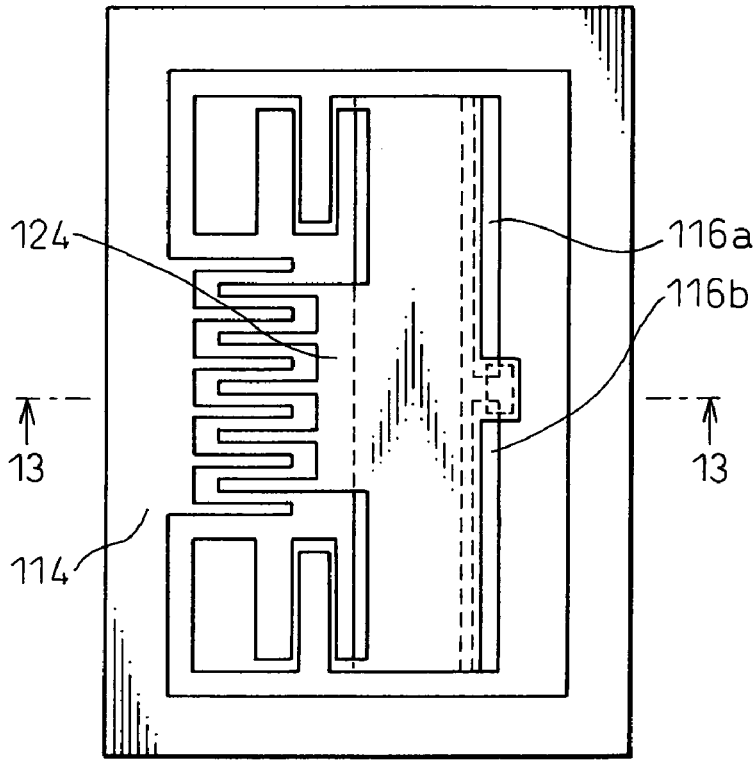
Figure 13A:
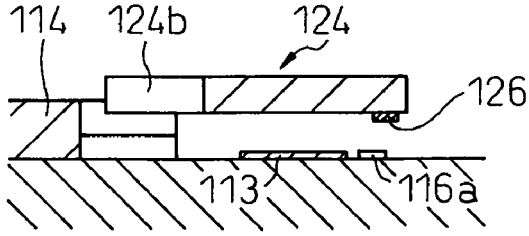
Figure 13B:
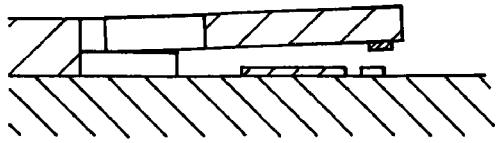
Figure 13C:
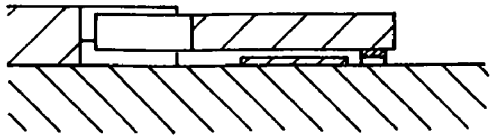
Figure 15A:
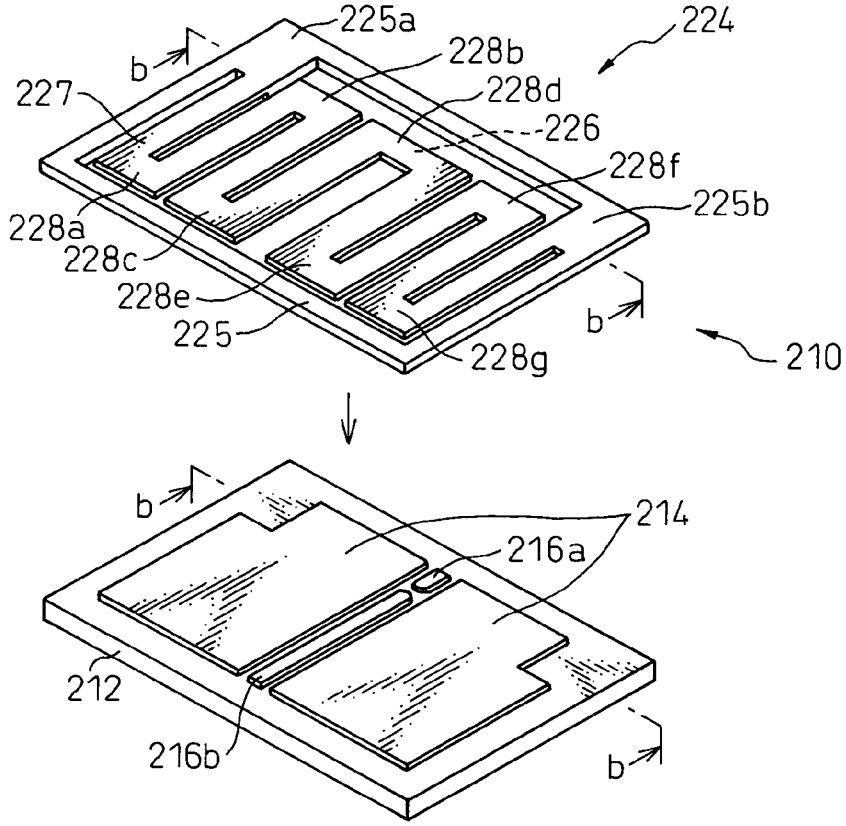
Figure 15B:
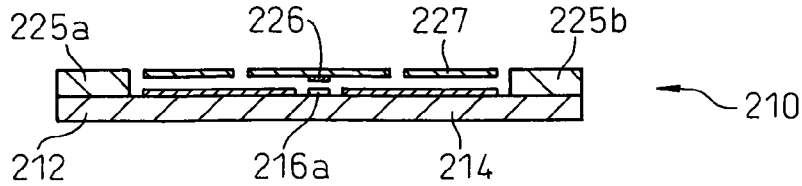

FIG. 11*a* is a cross-sectional view along 11-11 line of FIG. 10, when the contacts of the relay away from each other;

FIG. 11*b* is a view showing a condition in which the electrostatic attraction force between the comb-shaped structures of the micro relay is maximum;

FIG. 11*c* is a view when the contacts of the relay contact each other;

FIG. 12 is a view of a third modification of the micro relay of the second embodiment;

FIG. 13*a* is a cross-sectional view along 13-13 line of FIG. 12, when the contacts of the relay away from each other;

FIG. 13*b* is a view showing a condition in which the electrostatic attraction force between the comb-shaped structures of the micro relay is maximum;

FIG. 13*c* is a view when the contacts of the relay contact each other;

FIGS. 14*a*-14*e* show a series of diagrams of a method for producing a main part of the micro relay of the second embodiment, each representing removing a part of the material by etching, forming a moving contact, joining the material to a substrate, forming a fixed comb-shaped structure, and, forming moving electrode;

FIG. 15*a* is a schematic exploded view of a micro relay according to a third embodiment of the invention;

FIG. 15*b* is a schematic cross-sectional view of the micro relay of FIG. 15*a;*

Figure 16:
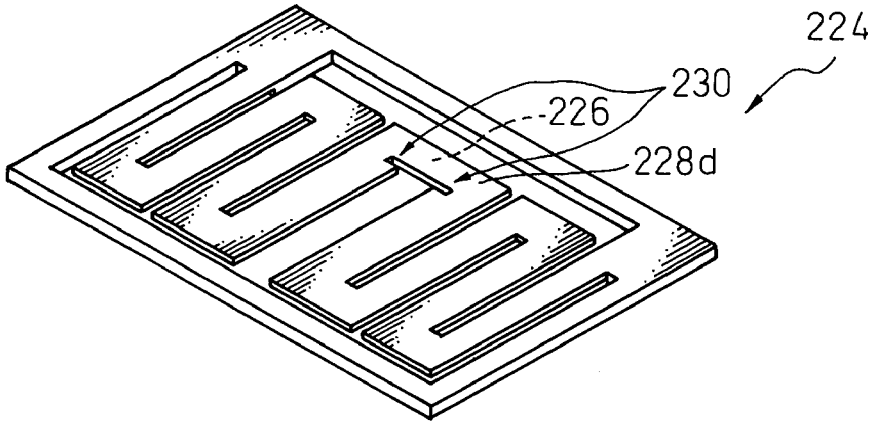
Figure 17A:
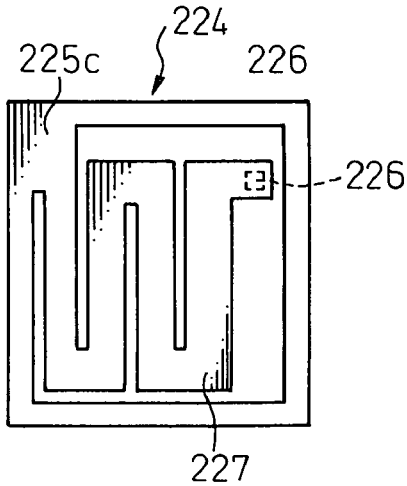
Figure 17B:
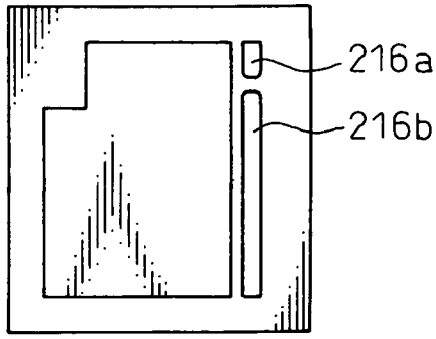

FIG. 16 is a schematic perspective view of a moving electrode of a first modification of the micro relay of the third embodiment;

FIG. 17*a* is a schematic plan view of a moving electrode of a second modification of the micro relay of the third embodiment;

FIG. 17*b* is a schematic plan view of a fixed electrode of the micro relay of FIG. 17*a;*

Figure 18A:
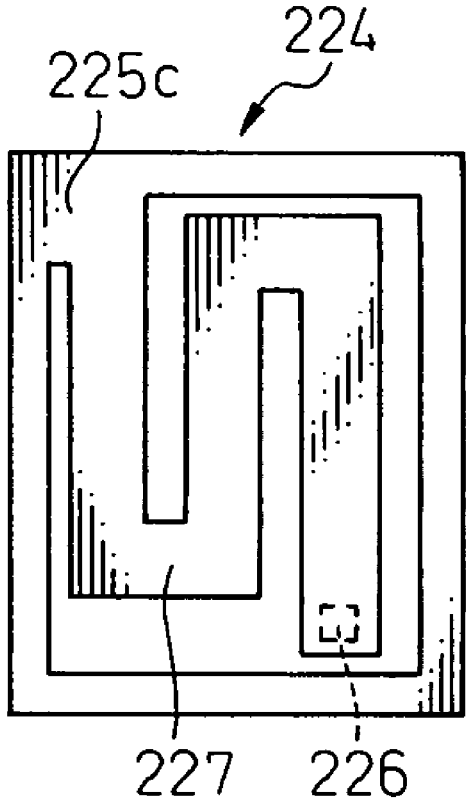
Figure 18B:
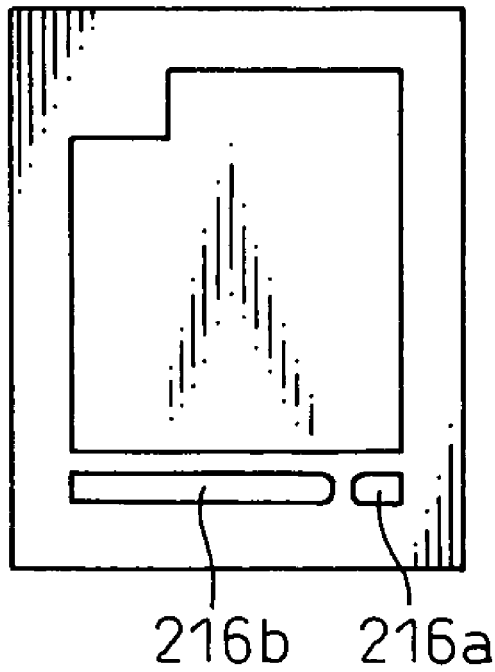

FIG. 18*a* is a schematic plan view of a moving electrode of a third modification of the micro relay of the third embodiment;

FIG. 18*b* is a schematic plan view of a fixed electrode of the micro relay of FIG. 18*a;*

Figure 19A:
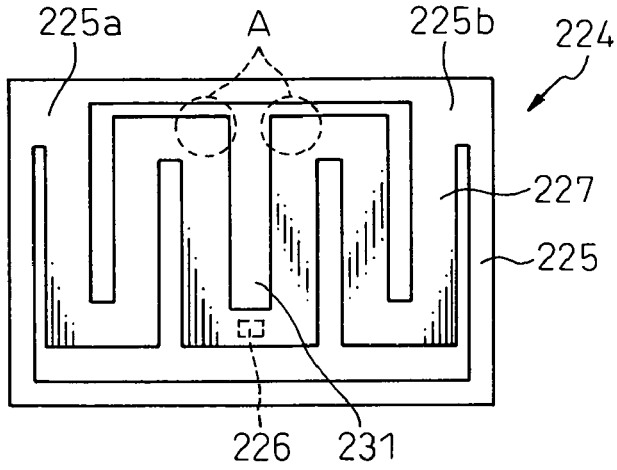
Figure 19B:
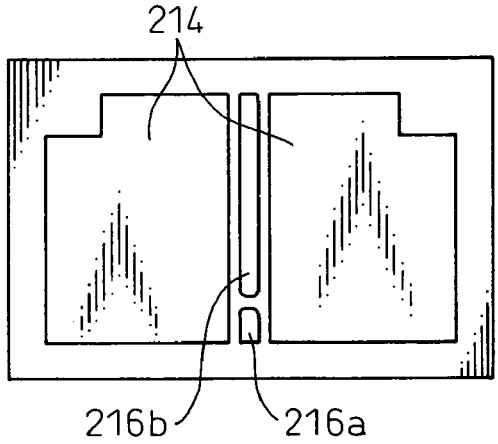

FIG. 19*a* is a schematic plan view of a moving electrode of a fourth modification of the micro relay of the third embodiment;

FIG. 19*b* is a schematic plan view of a fixed electrode of the micro relay of FIG. 19*a;*

Figure 20:
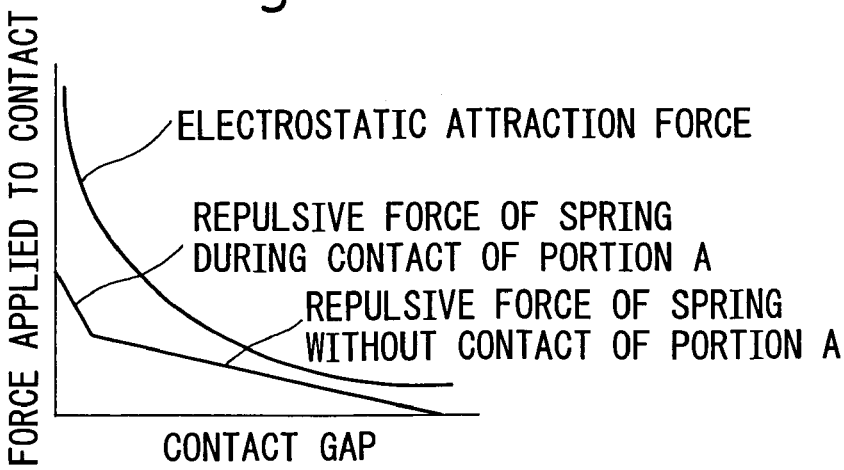
Figure 21A:
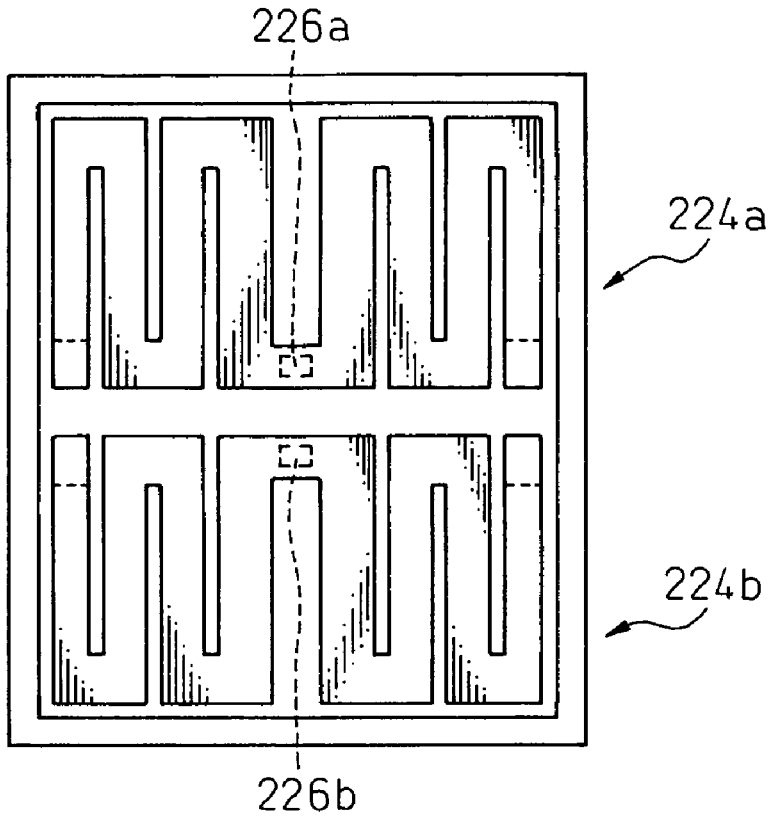
Figure 21B:
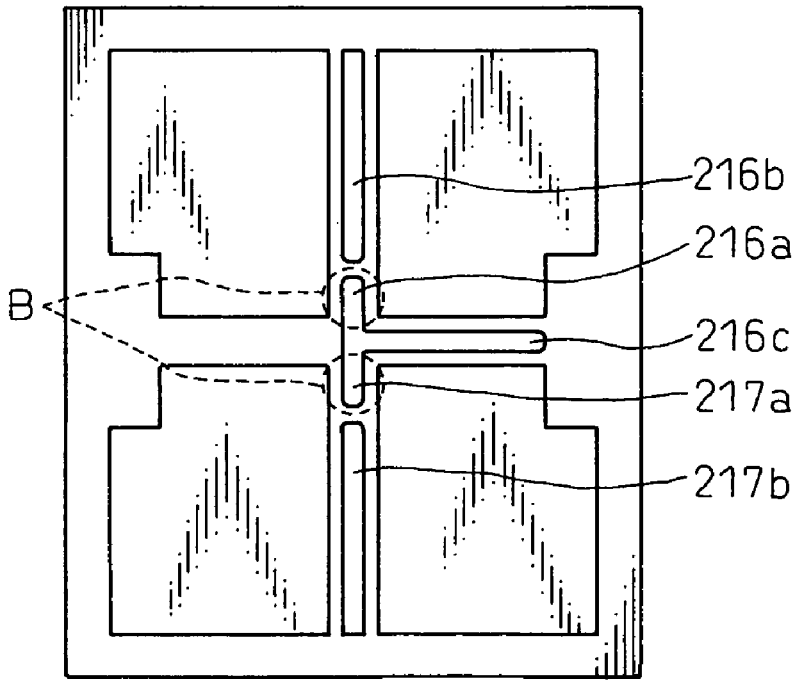

FIG. 20 is a graph indicating the electrostatic attraction force and the repulsing force of the spring portion in relation to the contact gap, in the fourth modification of the micro relay of the third embodiment;

FIG. 21*a* is a schematic plan view of a moving electrode of a fifth modification of the micro relay of the third embodiment;

FIG. 21*b* is a schematic plan view of a fixed electrode of the micro relay of FIG. 21*a;*

Figure 22A:
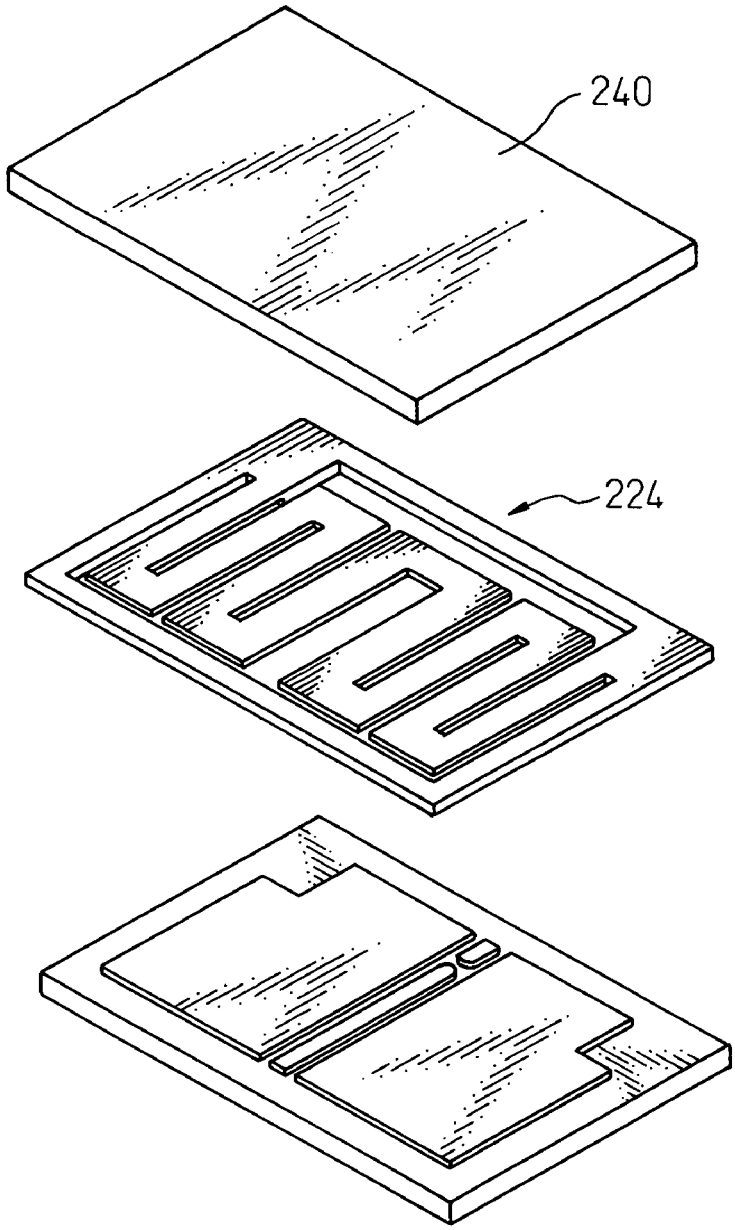
Figure 22B:
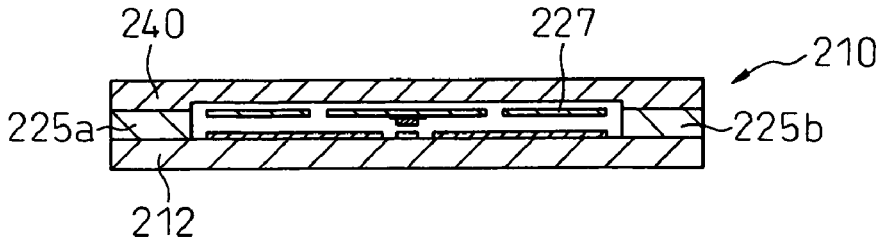

FIG. 22*a* is a schematic perspective view of a sixth modification of the micro relay of the third embodiment;

FIG. 22*b* is a schematic cross-sectional view of the micro relay of FIG. 22*a;*

Figure 23A:
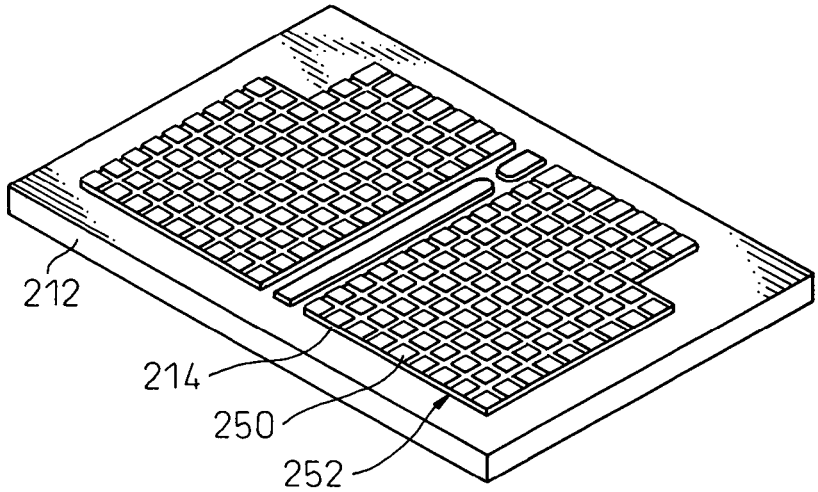
Figure 23B:
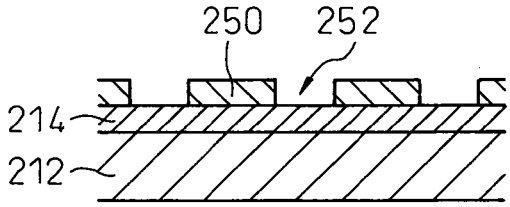
Figure 23C:
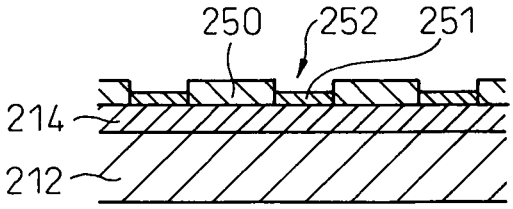

FIG. 23*a* is a schematic perspective view of a moving electrode of a seventh modification of the micro relay of the third embodiment;

FIG. 23*b* is a partial cross-sectional view of a fixed electrode of the micro relay of FIG. 23*a*; and FIG. 23*c* is a view of a modification of the constitution of FIG. 23*b*.

DETAILED DESCRIPTION

The present invention is explained below, with reference to drawings, by classifying it into three embodiments. All of the embodiments provide an electrostatic relay having a large contact gap and having reliability and high-performance regarding contacting and separating a moving contact with and from a fixed contact. In particular, a first embodiment relates to keeping clean the contact surfaces of a fixed contact and a moving contact. A second embodiment relates to the optimization of an electrostatic attraction force applied to a moving electrode. A third embodiment relates to the dispersion of the stress applied to a moving electrode having a moving contact.

Figure 1A:
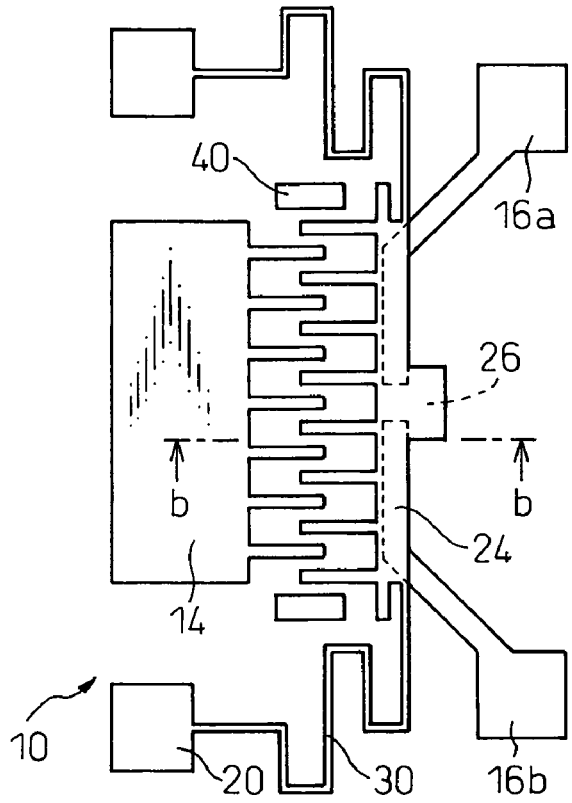
Figure 1B:
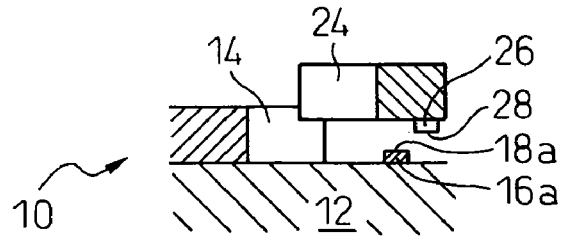
Figure 1C:
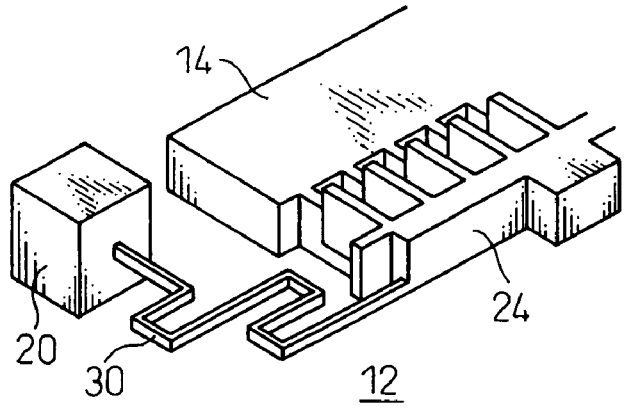
Figure 2A:
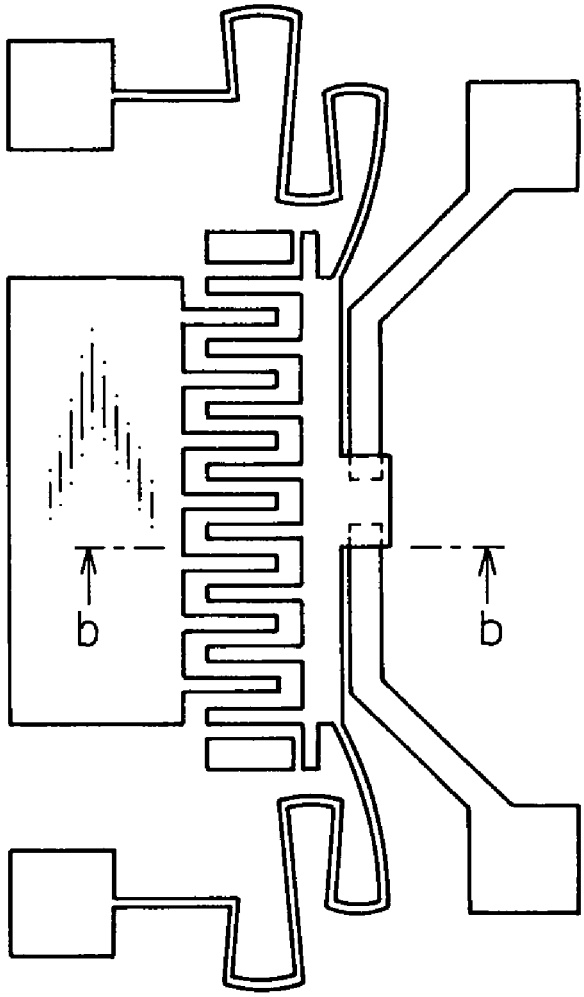
Figure 2B:
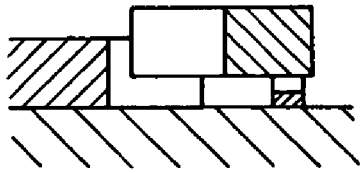
Figure 3A:
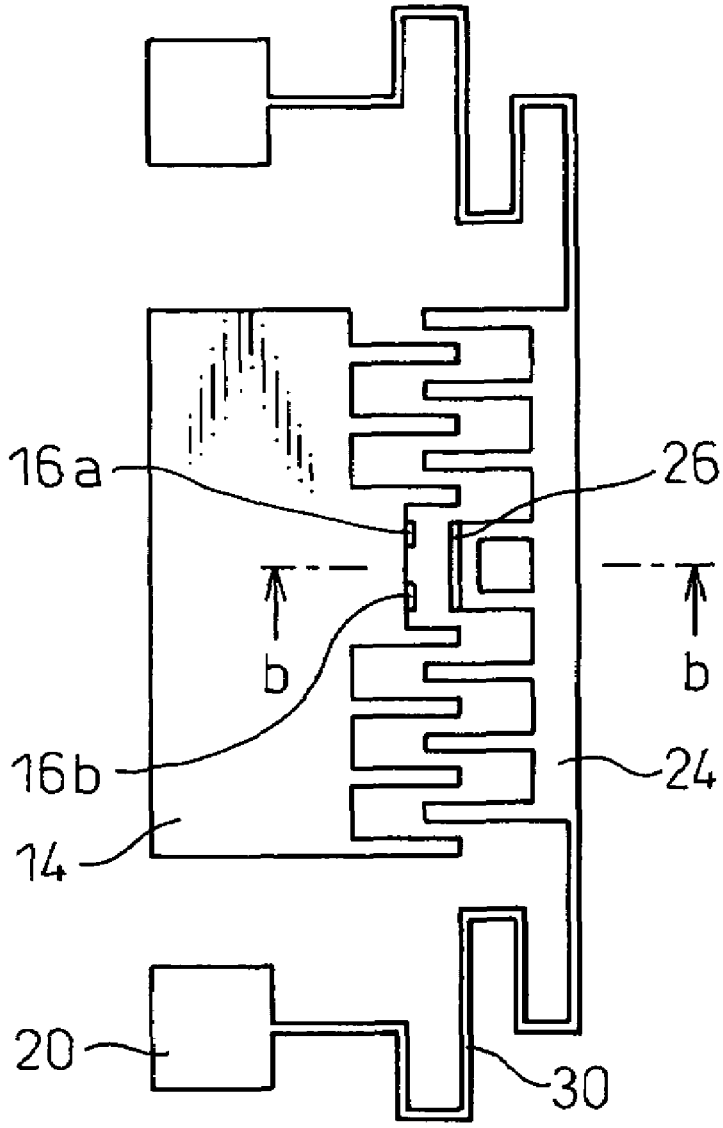
Figure 3B:
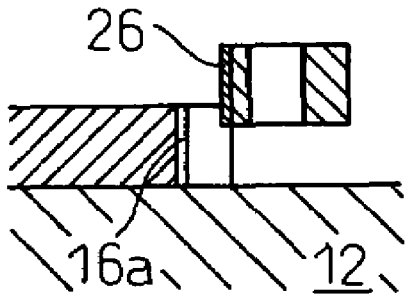
Figure 4A:
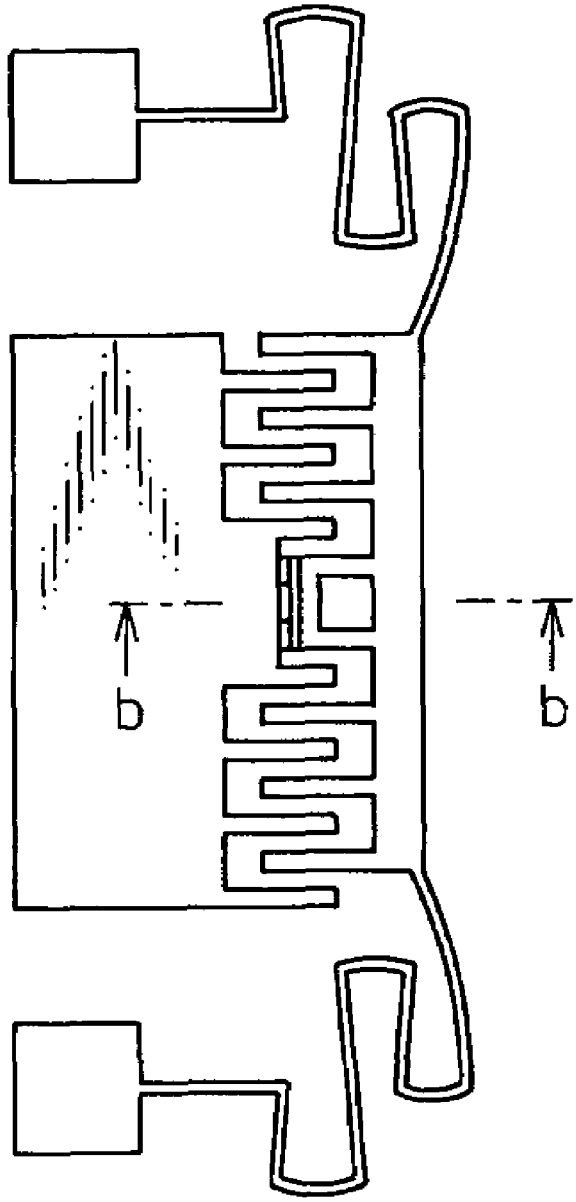
Figure 4B:
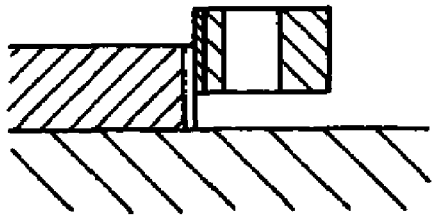

FIGS. 1*a*-2*b* show a basic constitution of an electrostatic micro relay 10 according to the first embodiment of the invention. Concretely, FIG. 1*a* shows when two contacts of the relay are separated from each other and FIG. 2*a* shows when the contacts contact each other. FIGS. 1*b* and 2*b* are cross-sectional views along b-b lines of FIGS. 1*a* and 2*a*, respectively. Further, FIG. 1*c* is a perspective view of FIG. 1*a*. In each drawing, components not related to the invention are omitted. The micro relay 10 includes a substrate 12 made of silicon or glass. On the substrate 12, a fixed comb-shaped electrode 14 having a fixed comb-shaped structure, two fixed contacts 16*a* and 16*b*, and a support part 20 for a moving electrode are arranged. The micro relay 10 further includes a moving comb-shaped electrode 24 and a moving contact 26 arranged on the moving electrode 24. The moving comb-shaped electrode 24 has a comb-shaped structure capable of facing the comb-shaped structure of the fixed electrode 14 and is movably supported by the support part 20 via a support means or a hinge spring 30. The stiffness or spring constant of the hinge spring 30 is determined such that the moving contact 26 of the moving electrode 24 is moved toward the contacts 16*a* and 16*b* and contacts both of the contacts (see FIG. 2*b*), due to an electrostatic attraction force, when a predetermined voltage is applied between the fixed electrode 14 and the moving electrode 24. The feature of the hinge spring 30 is to support the moving electrode 24 at an oblique upper position relative to the extending direction of the fixed electrode 14, when the moving electrode is away from the fixed electrode 14.

With reference to plan views as shown in FIGS. 1*a* and 2*a*, when the contacts of the fixed electrode 14 and the moving electrode 24 are separated from each other, the comb-shaped structures of the electrodes are away from each other in the extending direction of the comb-shaped structures in comparison to when the contacts of the electrodes contact each other, similar to the prior art. In the embodiment, further, as shown in FIGS. 1*b* and 1*c*, when the contacts are separated from each other, the electrodes together form a step-like figure. That is, the moving electrode 24 is supported obliquely above the fixed electrode 14. In other words, the comb-shaped structure of the moving electrode 24 extends parallel to but in the opposite direction relative to the extending direction of the comb-shaped structure of the fixed electrode 14, such that the two comb-shaped structures together form a step. When a predetermined voltage is applied between the electrodes 14 and 24, the moving electrode 24 is moved such that the distance between the electrodes along the extending direction of the comb-shaped structure is shorter and the step is smaller (i.e., the moving electrode is moved obliquely downward), whereby the moving contact 26 comes into contact with the fixed contacts 16*a*, 16*b*. Therefore, the distance or a contact gap between the fixed contacts and the moving contact may be longer than that of a comb type relay of the prior art in which comb-shaped structures move only in the horizontal direction. Therefore, the invention may provide a reliable relay with a high performance in relation to a discharge between the electrodes and a leakage of the high frequency signal. Further, when the contacts are separate from each other, the opposing areas of the fixed and the moving contacts are small and, therefore, the electrostatic capacity between the contacts is also small, whereby the leakage of the high frequency signal may be further reduced.

When a predetermined voltage is applied to the two electrodes of the micro relay 10 of the invention, the moving electrode 24 is moved obliquely downward (in the lower-left direction in FIG. 1*b*). On the other hand, each of contact surfaces 18*a*, 18*b* and 28 of the fixed contacts 16*a*, 16*b* and the moving contact 26 extends horizontally or parallel to the substrate 12, as shown in FIG. 1*b*. Therefore, the direction of movement of the moving electrode 24 and each contact surface together form an oblique angle, whereby the contact surface 28 of the moving contact can slidably contact the contact surfaces 18*a*, 18*b* of the fixed contacts. This slidable contact between them may cause a so-called wiping effect to keep each contact surface clean. Further, as the relay does not especially have a guide means or the like for the moving electrode 24 moving toward the fixed electrode 14, a contact site on each contact surface is not strictly the same every time when the moving contact abuts against the fixed contact. Therefore, the contact site is suitably distributed, on the contact surface, resulting in that the life of the relay may be greatly extended.

As shown in FIGS. 1*a* and 2*a*, a stopper 40 may be arranged on the substrate 12, for example, to limit the moving range of the moving electrode 24. As the attraction force generated between the two electrodes may be applied to both of the stopper 40 and the contact surfaces, it is possible to avoid an excessive force being applied to the contact surfaces 18*a*, 18*b* and 28. Therefore, the life of the relay may be extended by reducing wear and damage to each contact surface.

FIGS. 3*a*, 3*b*, 4*a* and 4*b* show a first variant of the first embodiment. This variant is different from the above relay in that the contact surfaces 18*a*, 18*b* and 28*a* of the fixed contacts 16*a*, 16*b* and the moving contact 26 extend vertically or perpendicular to the substrate 12. Also, in this case, the same effect as that of the embodiment of FIGS. 1*a*-2*b* may be obtained, as the contact surface 28 of the moving contact can slidably contact the contact surfaces 18*a*, 18*b* of the fixed contacts. Alternatively, the contact surfaces 18*a*, 18*b* and 28 may extend in a direction, other than the horizontal or vertical direction, which is not perpendicular to the direction of the movement of the moving electrode 24 toward the fixed electrode 14. This is because the moving contact surface may slide on the fixed contact surface to some extent when the surfaces are not arranged perpendicular to the direction of the movement of the moving electrode.

Figure 5A:
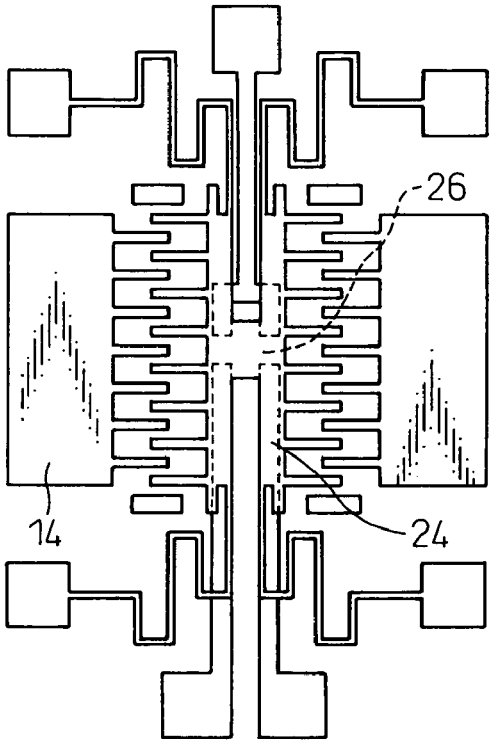
Figure 5B:
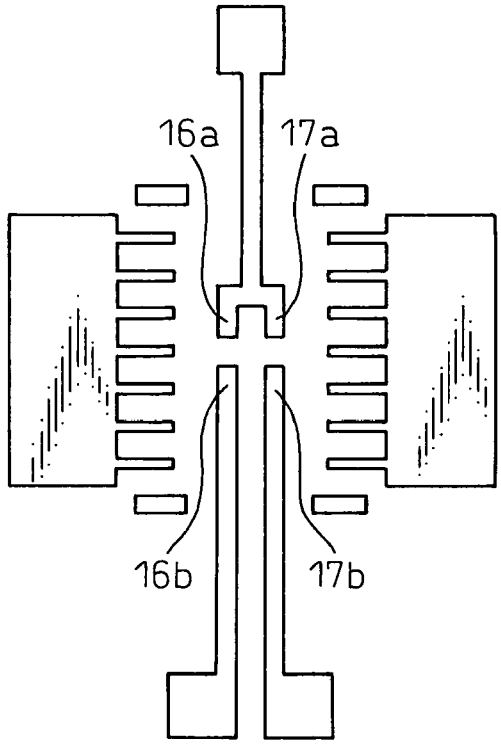

FIGS. 5*a* and 5*b* show a second variant of the first embodiment. In the second variant, two pairs of fixed contacts 16*a*, 16*b* and 17*a*, 17*b* are arranged, as shown in FIG. 5*b* and, together, they form a transfer type contact configuration (or a 1*c* contact configuration). As shown in FIG. 5*a*, the moving electrode 24 has two comb-shaped structures, each extending toward opposing direction. Therefore, the moving contact 26 may close one of the pairs of contacts 16*a*, 16*b* and 17*a*, 17*b*, or both of the pairs of contacts.

Next, with reference to FIGS. 6*a*-6*i*, a method of producing the basic structure of the micro relay of the invention is explained. All of FIGS. 6*a*-6*i* show the same side of the relay as FIG. 1*b*.

Figure 6A:
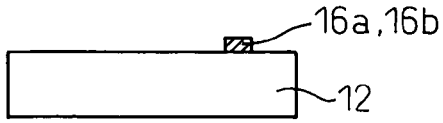

First, as shown in FIG. 6*a*, fixed contacts 16*a* and 16*b*, made by noble metal such as gold, are formed on a substrate 12 made by silicon or glass.

Figure 6B:
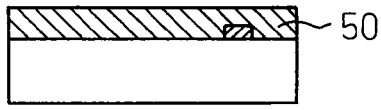
Figure 6C:
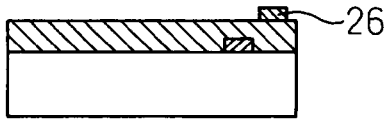

Next, as shown in FIG. 6*b*, a sacrificial layer 50 such as photoresist is formed on the surface of the substrate having the contacts. Further, as shown in FIG. 6*c*, a moving contact 26 is formed on the sacrificial layer 50.

Figure 6D:
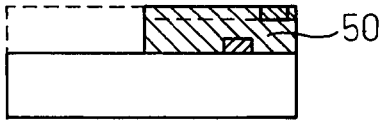

Next, as shown in FIG. 6*d*, the sacrificial layer 50 is reconstructed or thickened, then, a part of the layer is removed by patterning.

Figure 6E:
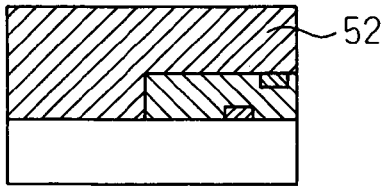

Then, as shown in FIG. 6*e*, a structural layer 52, resulting in the comb-shaped structures of the fixed and moving electrodes 14 and 24, is formed on the sacrificial layer 50 and the substrate 12. As the material of the structural layer 52, conventional poly-silicon or glass may be used. Further, it is preferable that organic material with high heat resistance such as polyimide may be used, whereby a relay with high heat resistance may be obtained. The organic material such as polyimide may be used for a movable member of the relay such as the moving electrode of all embodiments of the invention.

Figure 6F:
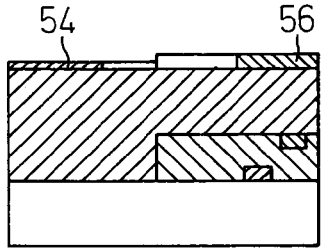

Next, as shown in FIG. 6*f*, a first mask 54 and a second mask 56 are formed on the structural layer 52 and, then, a part of each mask is removed by patterning.

Figure 6G:
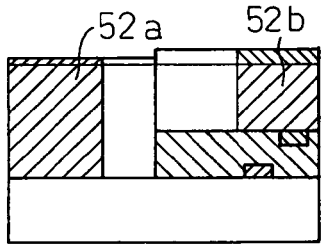
Figure 6H:
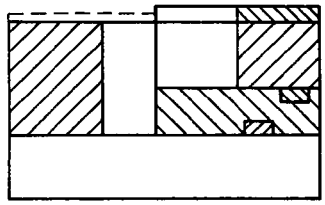

Next, as shown in FIG. 6*g*, an unnecessary part of the structural layer 52 (for example, a part corresponding to gaps of the comb-shaped structure) is removed by etching such that a plurality of (two in this embodiment) comb-shaped structures 52*a* and 52*b* are formed. Then, the first mask 54 is removed, as shown in FIG. 6*h*.

Figure 6I:
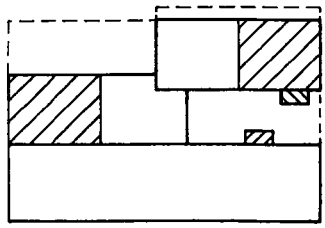

Next, as shown in FIG. 6*i*, the two comb-shaped structures are etched such that the two structures together form a step. Then, electric conductors are formed on the structures 52*a* and 52*b*, the second mask 56 is removed and, finally, the sacrificial layer 50 is removed.

The above method is merely one example. Therefore, the structures may be formed by plating for making a thick film, or, by deep etching of a silicon substrate.

Figure 7A:
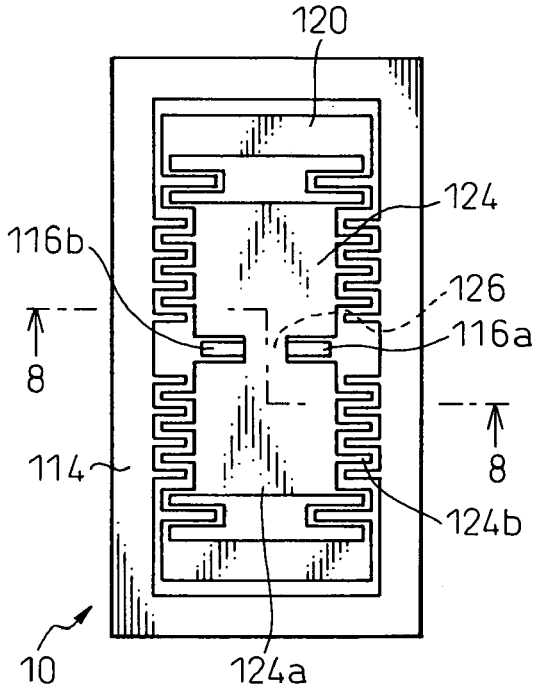
Figure 7B:
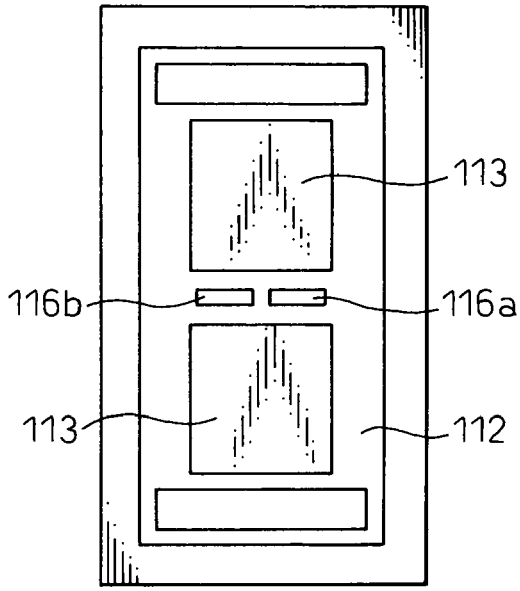

In the next place, a basic constitution of an electrostatic micro relay 110 according to the second embodiment of the invention is explained. The micro relay 110 is basically a parallel plate type, as shown in FIGS. 7*a* and 7*b*. The relay 110 includes a substrate 112 made of silicon or glass. On the substrate 112, a first fixed electrode or a fixed electrode plate 113, two fixed contacts 116*a*, 116*b* and a movable electrode support 120. A moving electrode 124, including a plate portion 124*a* parallel to the substrate 112 and a moving contact 126 arranged on the plate portion 124*a*, is movably supported by the electrode support 120 such that the moving electrode 124 may be perpendicularly moved relative to the surface of the substrate 112. Due to such a configuration, when a predetermined voltage is applied between the fixed electrode plate 113 and the moving electrode 124, the plate portion 124*a* of the moving electrode 124 is moved toward the fixed contacts 116*a* and 116*b* by the electrostatic attraction force, whereby the moving contact 126 of the moving electrode 124 comes into contact with the fixed contacts.

The micro relay 110 of the invention further includes a second fixed electrode or a fixed comb-shaped electrode 114 and the moving electrode 124 further has a comb-shaped structure 124*b* capable of engaging with the comb-shaped electrode 114. In such a relay, of the parallel plate type, by arranging the comb-shaped electrode 114 other than at the fixed electrode plate and by providing the comb-shaped structure to the moving electrode 124, another electrostatic attraction force between the comb-shaped electrode 114 and the comb-shaped structure 124*b* of the moving electrode 124 may be obtained, as well as the electrostatic attraction force between the fixed electrode plate 113 and the plate portion 124*a* of the moving electrode 124. Therefore, the total attraction force applied to the moving electrode 124 may be significantly increased in comparison to the conventional parallel plate type relay. Due to the high attraction force, the contact gap may be increased, whereby a high performance relay may be obtained.

Figure 8A:
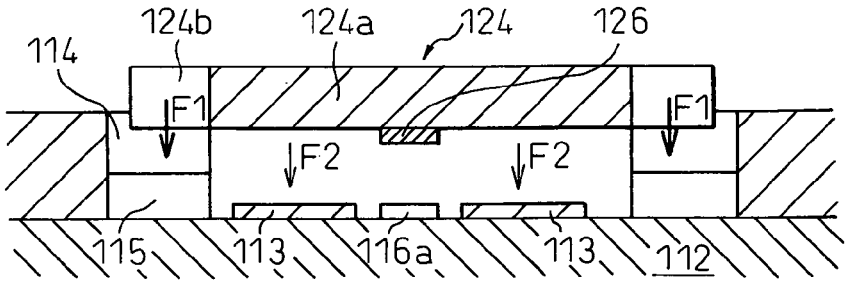

However, when the electrostatic attraction force is increased by providing the comb-shaped structure to the micro relay 110, the impact force generated by the contact between the fixed contacts 116*a*, 116*b* and the moving contact 126 and the contact force between them after the contact are also increased. The impact and contact forces may raise a risk of the damage and wear of each contact and sticking between the contacts. Therefore, in the second micro relay 110, as shown in FIG. 8*a*, the fixed comb-shaped electrode 114 has an insulating layer 115 formed on the side of the comb-shaped structure of the electrode 114 facing the substrate 112. The insulating layer 115 may be replaced with a gap. The height of the insulating layer 115 or the gap is larger than any of the heights of the fixed electrode plate 113 and fixed contacts 116*a*, 116*b*. Due to this configuration, the impact and contact force between the contacts may be suitably controlled. The reason for this is explained below.

FIG. 8*a* shows a cross-sectional view along 8-8 line of FIG. 7*a*, just after a voltage is applied between the contacts, i.e., the moving contact starts to move toward the fixed contacts. Generally, the attraction force applied to the moving electrode 124 may be divided into a force F1 generated between the comb-shaped structure 124*a* of the moving electrode 124 and the fixed comb-shaped structure 114 and a force F2 generated between the plate portion 124*b* of the moving electrode 124 and the fixed electrode plate 113. In the state of FIG. 8*a*, the force F1 is larger than the force F2. Therefore, the major force for moving the moving electrode 124 downward, just after the voltage is applied, is the force F1.

Figure 8B:
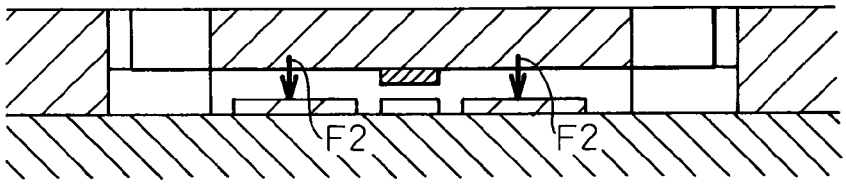

In the state of FIG. 8*b*, the attraction force F1 becomes a maximum. Therefore, the comb-shaped structure 124*a* of the moving electrode 124 is intended to retain this position. However, in this state, as the gap between the plate portion 124*b* of the moving electrode 124 and the fixed electrode plate 113 is shorter than that in the state of FIG. 8*a*, the attraction force F2 is considerably increased. Therefore, the moving electrode 124 is further lowered by the increased attraction force F2.

Figure 8C:
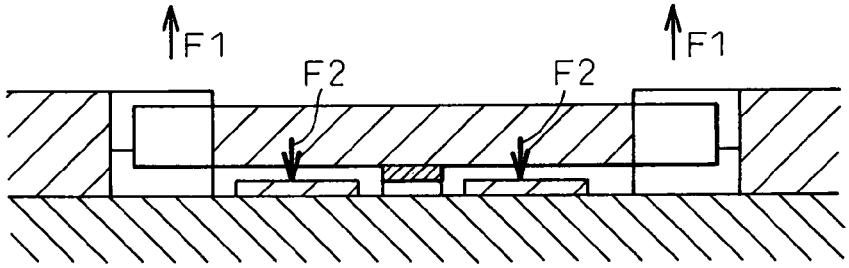

In the state of FIG. 8*c*, the moving contact 126 comes into contact with the fixed contacts 116*a*, 116*b* and the force F2 becomes a maximum. In this state, however, the attraction force F1 works in the upper direction on the comb-shaped structure 124*a* of the moving electrode 124. In a conventional parallel plate type relay, the undesirably high impact and contact forces may be applied to the contacts by the attraction force F2. On the contrary, in the micro relay 110 of the invention, the impact and contact forces may be reduced by the force F1 intending to raise the moving electrode when the force F2 is large.

In other words, the force F1 works to lower the moving electrode 124 just after the voltage is applied and is intended to raise the moving electrode when the moving contact contacts the fixed contact for reducing the impact and contact forces. Therefore, the contact gap between the contacts when the voltage is not applied may be increased, further, the damage and wear to the contacts may be reduced and sticking between the contacts may be avoided, whereby the life of the contacts may be greatly extended.

Figure 9:
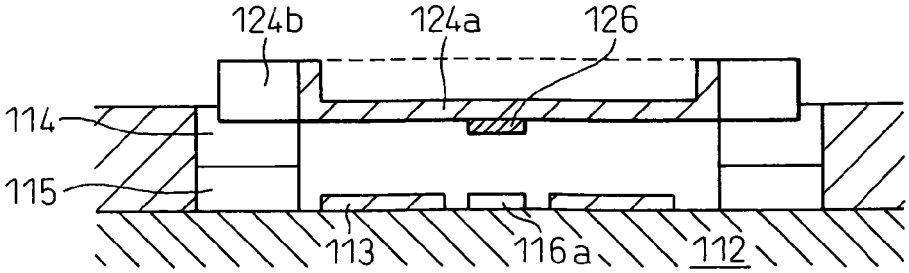
FIG. 9 is a view similar to FIG. 8*a*, showing a first modification of the micro relay of the second embodiment.

FIG. 9 shows a first modification of the micro relay 110. The feature of this modification is that the plate portion 124*b* of the moving electrode 124 is thinner than the comb-shaped structure 124*a*. Due to this configuration, the weight of the moving electrode 124 may be reduced and, therefore, the impact force when the moving contact comes into contact with the fixed contact, whereby the damage and wear to the contacts may be reduced. Further, as the moving contact may be easily separated from the fixed contact, a malfunction of the micro relay is avoided.

FIG. 10 shows a second modification of the micro relay 110. The feature of this modification is that the comb-shaped structure 124*a* is formed on only one side of the moving electrode 124. The advantage of this configuration is the wiping effect between the contacts, as described below.

FIGS. 11*a*-11*c* are cross-sectional views along the 11-11 line of FIG. 10, similarly to FIGS. 8*a*-8*c*. When a voltage is applied to the relay on the state of FIG. 11*a* in which the moving contact 126 is away from the fixed contacts 116*a*, 116*b*, the comb-shaped structure 124*a* of the moving electrode 124 is moved by the above attraction force F1, until the height position of the comb-shaped structure 124*a* is generally equal to that of the fixed comb-shaped electrode 114, as shown in FIG. 11*b*. As the comb-shaped structure 124*a* is formed on only one side of the moving electrode 124, the moving electrode 124 inclines in this state. Therefore, the moving contact 126 may slightly slide on the fixed contacts 116*a*, 116*b*, when the moving contact comes into contact with the fixed contacts due to the attraction force F2 (FIG. 11*c*). Therefore, a wiping effect may be also obtained in this case, whereby each of the contact surfaces of the contacts may be kept clean.

FIG. 12 shows a third modification of the micro relay 110. The feature of this modification is the same as the second modification in that the comb-shaped structure 124*a* is formed on only one side of the moving electrode 124, but is different from the second modification in that the position of the moving contact 126 on the plate portion 124*b* of the moving electrode 124 is different. In detail, as shown in FIG. 12, the moving contact 126 is arranged on or near the end of the plate portion 124*b* and away from the comb-shaped structure 124*a*. Due to this configuration, the wiping effect may be further enhanced. In other words, as shown in FIGS. 13*a*-13*c*, although the motion of the moving electrode 124, from the application of the voltage to the contact of the contacts, is the same as that of FIGS. 11*a*-11*c*, as the distance between the moving contact 126 and the comb-shaped structure 124*a* in the third modification is larger than that of the second modification (FIGS. 11*a*-11*c*), the sliding distance of the moving contact on the fixed contacts in the third modification is larger than that of the second modification.

FIGS. 14*a*-14*e* show a method for producing a main part of the micro relay 110 of FIG. 10.

Figure 14A:
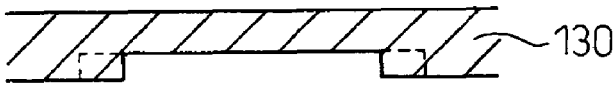

First, as shown in FIG. 14*a*, material 130, such as silicon, glass or polyimide, constituting the fixed comb-shaped electrode 114 and the moving electrode 124, is prepared. Then, a part of the material 130 is removed by etching, so as to form a lower surface of the moving electrode 124.

Figure 14B:
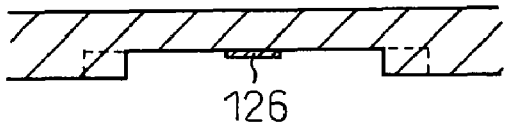

Next, as shown in FIG. 14*b*, the moving contact 126 is formed on the lower surface of the material 130.

Figure 14C:
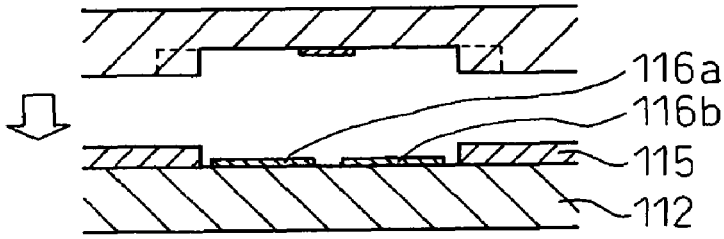

Next, as shown in FIG. 14*c*, the substrate 112 made from silicon or glass, having the fixed electrode (not shown), the fixed contacts 116*a*, 116*b* and the insulating layer 115 arranged on the substrate, is prepared. The above material 130 is then joined to the insulating layer 115 on the substrate.

Figure 14D:
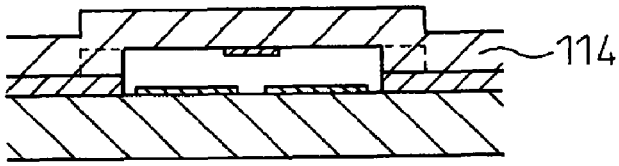

Next, as shown in FIG. 14*d*, the fixed comb-shaped electrode 114 is formed by etching.

Figure 14E:
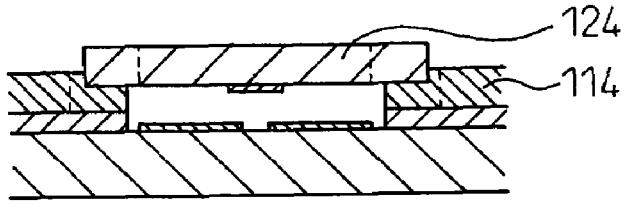

Finally, as shown in FIG. 14*e*, the moving electrode 124 is formed by removing a part of the material 130 by etching, such that the moving electrode may move relative to the fixed comb-shaped electrode 114.

Next, a basic constitution of an electrostatic micro relay 210 according to the third embodiment of the invention is explained. As shown in FIGS. 15*a* and 15*b*, the micro relay 210 includes a substrate 212 made of silicon or glass. On the substrate 212, a fixed electrode 214 and two fixed contacts, 216*a* and 216*b*, are arranged. The micro relay 210 further includes a moving electrode 224 having a moving contact 226 generally at the center of the moving electrode. The moving electrode 224 has a frame portion 225 and a movable spring portion 227. The spring portion 227 is connected to at least one end (two ends 225*a* and 225*b*, in this embodiment) such that the spring portion 227 is capable of moving vertically or perpendicularly to the face of the substrate 212. In detail, the spring portion 227 has a suitable stiffness or a spring constant such that the moving contact 226 formed on the spring portion 227 may be moved and come to contact with the fixed contacts 216*a*, 216*b* when a predetermined voltage is applied between the fixed electrode 214 and the moving electrode 224.

As shown in FIG. 15*a*, the spring portion 227 of the moving electrode 224 has a plurality of turned portions (seven turned portions 228*a*-228*g*, in this embodiment). Further, at least one of the turned portions (three turned portions, in this embodiment) are positioned between the ends 225*a* and 225*b* connected to the spring portion 227. Due to this configuration, the spring portion 227 may bend at each turned portion when the moving contact 226 contacts the fixed contacts 216*a*, 216*b*. Therefore, the distance between the moving contact 226 positioned at generally the center of the spring portion 227 and fixed contacts 216*a*, 216*b* (i.e., the contact gap) may be lengthened. Further, as the flexure of the spring portion 227 at each turned portion may be relatively small, whereby the stress (mainly the torsional stress) applied to each turned portion may also be small. In other words, the stress applied to the whole spring portion may be dispersed to the plurality of turned portions. In addition, a labyrinth or a meander is shown as one example of the spring portion 227 having the plurality of turned portions, as shown in FIG. 15*a*. However, other configurations, in which the fixed electrode includes a plurality of portions capable of displacing in order to disperse the stress, may be possible.

In a first modification of the third embodiment, the moving electrode 224 may have a notch 230 at the turned portion, as shown in FIG. 16. By means of the notch 230, the stress applied to the turned portion having the notch may be further reduced. Especially, when the notch is formed at the turned portion 228*d* having the moving contact 226 thereon, the balance of the moving contact 226 may be stable during movement of the moving contact.

FIGS. 17*a* and 18*a* show second and third modifications of the micro relay 210, respectively. The micro relay of either the second or the third modification is a cantilever type relay, different from the relay of FIG. 15*a*, in which the spring portion 227 of the moving electrode 224 is connected to one end 225*c* of the frame portion 225. In FIG. 17*a*, the end 225*c* and the moving contact 226 are positioned on the same side (or the upper side in FIG. 17*a*) of the relay. In FIG. 18*a*, on the other hand, the end 225*c* and the moving contact are positioned on the end of one diagonal line of the relay. However, as both of the modifications have a plurality of turned portions, the stress applied to the spring portion may be dispersed, similarly to the embodiment of FIG. 15*a*. In addition, in each of the modifications of FIGS. 17*a* and 18*a*, the fixed contacts 216*a*, 216*b* on the substrate 212 are configured to contact each other when the moving contact comes into contact with the fixed contacts, as shown in FIGS. 17*b* and 18*b*.

In a fourth modification of the third embodiment of the micro relay as shown in FIGS. 19*a* and 19*b*, a part of the spring portion 227 other than the moving contact 226 may be contacted to the fixed electrode 214 before the moving contact 226 contacts the fixed contacts 216*a*, 216*b*. In one example of the configuration of the moving electrode 224 for achieving the above motion, the spring portion 227 has two fixed ends 225*a* and 225*b* connected to the frame 225 on each side, the moving contact 226 is positioned at the generally center of the spring portion 227, the two fixed ends 225*a*, 225*b* and the moving contact 226 are not positioned on one straight line. Further, the spring portion 227 has a slit 231, on the center of the spring portion 227, extending from the point near the moving contact 226 to the opposite side to the moving contact. Due to this configuration, two portions adjacent to the slit 231 on the opposite side of the spring portion 227 to the moving contact 226, as shown by "A" in FIG. 19*a*, may contact a part of the fixed contact 214 before the moving contact 226 contacts the fixed contacts 216*a*, 216*b*. In this case, the two portions shown by "A" are insulated from the part of the fixed contact 214. In other words, as each of the two portions may serve as a supporting point of the spring portion when the moving contact is separated from the fixed contacts, the separating force for separating the moving contact from the fixed contacts may be increased by non-linearly changing the repulsive force of the spring portion, as shown in FIG. 20. In the relay or the MEMS element described in the above Japanese Unexamined Patent Publications (Kokai) No. 2002-289081 and No. 2002-326197, the separating force may be also increased by non-linearly changing the repulsive force of the spring, however, a protrusion must be further arranged on a movable element. In the micro relay according to the invention, on the contrary, only a slit is formed on the spring portion of the moving electrode, without high dimensional accuracy. Therefore, the micro relay may be advantageously easily machined and the weight of the relay may be reduced.

FIGS. 21*a* and 21*b* show a fifth modification of the third embodiment. In the fifth modification, as shown in FIG. 21*a*, two moving electrodes 224*a* and 224*b* have moving contacts 226*a* and 226*b*, respectively. Further, as shown in FIG. 21*b*, two pairs of fixed contacts 216*a*, 216*b* and 217*a*, 217*b* are arranged on the substrate, whereby a 1*c* contact configuration may be constituted. As shown, the fixed contacts 216*a* and 217*a* are connected to each other by means of a common terminal 216*c*, and preferably extend opposing directions from the end of the common terminal. The two moving contacts may be independently moved, whereby the 1*c* contact configuration, in which one moving contact is "ON" and the other is "OFF", may be constituted. In this case, two portions extending from the common terminal 216*c* to the fixed contacts 216*a* and 217*a*, as shown by "B" in FIG. 21*b*, may be unnecessary protrusions or "stubs", when the corresponding moving contact is "OFF" or separated from the fixed contact. These stubs may adversely affect on the transmission of a high frequency signal, which is a major application of the micro relay. In the micro relay according to the invention, as the moving contacts 226*a* and 226*b* may be closely positioned to each other, the above stubs may be shortened such that the above adverse effect does not substantially occur. Therefore, the transmission characteristic of a high frequency signal through the micro relay may be improved.

The third embodiment of the micro relay, as shown in a sixth modification of FIGS. 22*a* and 22*b*, may have a cap substrate 240 for sealing the moving part of the relay. Wiring for connecting the inside parts of the relay (for example, the fixed contact, and the spring portion and a signal line) to the outside of the relay may be possible by a through hole (not shown) extending through the substrate 212. The through hole may be formed by etching for forming a hole on the substrate and plating for filling the hole with a metal. The cap substrate 240, the frame portion 225 of the moving electrode and the substrate 212 may be joined to each other by anode joining, brazing or directly joining between silicon and silicon. By sealing the moving part of the relay, dust or gas from the outside, which may adversely affect on the contacts or the spring portion, is not allowed to enter into the relay, whereby the reliability and performance of the relay may be maintained. Also, this sealing mechanism may be applied to the above first and second embodiments.

FIGS. 23*a*-23*c* show a seventh modification of the third embodiment. In the seventh modification, as shown in FIG. 23*a*, an insulating membrane 250, formed on the surface of the fixed electrode 214 on the substrate 212, has grooves 252 together forming a lattice. As the spring portion 227 of the moving electrode 224 is moved toward the fixed electrode 214 by the electrostatic attraction force, at least one of the surfaces of the spring portion 227 and the fixed electrode 214 must have an insulating membrane, such as a silicon oxide film, for avoiding a short circuit. According to the invention, by forming the grooves 252 on the insulating membrane 250, the contact area between the spring portion 227 and the fixed contact 214 may be reduced and sticking between them may be avoided. The bottom area of the grooves 252 may be the surface of the fixed electrode 214, as shown in FIG. 23*b*. Alternatively, the bottom area may have another insulating membrane 251, as shown in FIG. 23*c*. In addition, the surface of the moving electrode may have an insulating membrane, not shown, having grooves forming a lattice, in order to obtain the same effect.

In the third embodiment, the width, the length and the number of the turned portions of the spring portion may be suitably varied. As the material of the moving electrode, monocrystalline silicon, poly-silicon, metal or plastic may be used. When an insulating material such as plastic is used for the material of the moving electrode, a metal plate may be formed on the surface of the electrode. On the other hand, when a conductive material is used for the material of the moving electrode, an insulating membrane may be formed between the body of the moving electrode and the moving contact.

According to the present invention, the micro relay having the configuration capable of keeping of the cleanliness of the contact surfaces of the fixed contact and the moving contact, by slidably contacting the moving contact with the fixed contact, is provided. Also, the micro relay having the configuration capable of increasing the electrostatic attraction force applied to the moving electrode before the moving contact contacts the fixed contact and, reducing the attraction force after the moving contact contacts the fixed contact, is provided. Further, the micro relay having the configuration capable of dispersing the stress applied to the moving electrode having moving contact and extending the life of the moving electrode. In any of the micro relays, the contact gap between the moving and fixed contacts may be increased.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. An electrostatic relay comprising:

a fixed contact having a contact surface;

a fixed electrode having a fixed comb-shaped structure;

a moving electrode having a movable comb-shaped structure movably supported and positioned away from the fixed electrode, the movable comb-structure extending in the direction opposing and parallel to the extending direction of the fixed comb-shaped structure such that the movable and fixed comb-shaped structures together form a step extending in a direction generally perpendicular to the extending direction of the fixed comb-shaped structure;

a moving contact attached to the moving electrode and having a contact surface capable of being contacted with and separated from the contact surface of the fixed contact, the contact surface of the moving contact being positioned at an oblique upper position relative to the contact surface of the fixed contact in relation to the extending direction of the fixed electrode when the moving electrode is separated from the fixed electrode;

wherein when a predetermined voltage is applied between the fixed electrode and moving electrode, the moving electrode moves such that the distance between the fixed and the movable comb-shaped structures is reduced and the height of the step formed by the movable and fixed comb-shaped structures is reduced and such that the contact surfaces of the moving contact and the fixed contract slidably contact each other.

2. The electrostatic relay as set forth in claim 1, wherein the direction of movement of the moving electrode forms an oblique angle with at least one of the contact surface of the fixed contact and the contact surface of the moving contact.

3. The electrostatic relay as set forth in claim 1, further comprising a stopper for limiting the extent of the movement of the moving electrode.

4. The electrostatic relay as set forth in claim 1, further comprising a cap substrate for sealing a moving part of the electrostatic relay.

5. The electrostatic relay as set forth in claim 1, wherein the electrostatic relay comprises at least two fixed contacts.

6. The electrostatic relay as set forth in claim 1, wherein the moving electrode is made of an organic material including polyimide.

* * * * *